US007004411B2

(12) United States Patent
Nuora et al.

(10) Patent No.: US 7,004,411 B2
(45) Date of Patent: Feb. 28, 2006

(54) TRANSPORT LOCKING FOR A VIBRATING FEEDER OF A MOBILE CRUSHING UNIT

(75) Inventors: Marko J. Nuora, Tampere (FI); Esko A. Hyttinen, Kangasala (FI); Seppo J. Koskenkorva, Nokia (FI); Reijo K. Kankaanpää, Tampere (FI); Joonas O. Aaltonen, Tampere (FI); Jouni M. Koivumäki, Siivikkala (FI); Jouni J. Hulttinen, Länsi-Teisko (FI)

(73) Assignee: Metso Minerals (Tampere) OY, Tampere (FI)

( * ) Notice: Subject to any disclaimer, the term of this patent is extended or adjusted under 35 U.S.C. 154(b) by 5 days.

(21) Appl. No.: 10/381,459

(22) PCT Filed: Aug. 26, 2002

(86) PCT No.: PCT/FI02/00690

§ 371 (c)(1),
(2), (4) Date: May 14, 2003

(87) PCT Pub. No.: WO03/018206

PCT Pub. Date: Mar. 6, 2003

(65) Prior Publication Data

US 2004/0035963 A1 Feb. 26, 2004

(30) Foreign Application Priority Data

Aug. 31, 2001 (FI) ..... 20011740

(51) Int. Cl.
*B02C 21/02* (2006.01)

(52) U.S. Cl. ..... 241/101.74; 241/81; 241/101.71; 241/186.3

(58) Field of Classification Search ..... 241/81, 241/101.71, 101.74, 186.3
See application file for complete search history.

(56) References Cited

U.S. PATENT DOCUMENTS

| | | | | |
|---|---|---|---|---|
| 5,074,435 | A * | 12/1991 | Suverkrop et al. | 222/55 |
| 5,460,332 | A * | 10/1995 | Frick | 241/101.74 |
| 5,797,548 | A * | 8/1998 | Tamura et al. | 241/35 |
| 6,354,524 | B1 * | 3/2002 | Nakayama et al. | 241/101.74 |
| 2003/0062434 | A1 * | 4/2003 | Moriya et al. | 241/101.74 |

FOREIGN PATENT DOCUMENTS

| | | |
|---|---|---|
| JP | 07-116539 | 5/1995 |

* cited by examiner

*Primary Examiner*—Derris H. Banks
*Assistant Examiner*—Jason Y. Pahng
(74) *Attorney, Agent, or Firm*—Oliff & Berridge, PLC

(57) ABSTRACT

A transport locking arrangement is disclosed for a vibrating feeder of a mobile crushing unit, the transport locking arrangement utilizing the downward rotatable sidewalls of the feeder hopper of the vibrating feeder that are hingedly mounted on the framework of said crushing unit, whereby the sidewalls in their lower position are adapted to lock the vibrating feeder substantially rigidly to the framework of the crushing unit. The invention offers a rapid and easy technique of transport locking for a vibrating feeder.

9 Claims, 5 Drawing Sheets

TRANSPORT LOCKING FOR A VIBRATING FEEDER OF A MOBILE CRUSHING UNIT

The present invention relates to mobile crushing units. More specifically, the invention relates to a transport locking arrangement for the vibrating feeder of such a mobile crushing unit.

Conventionally, a mobile crushing unit comprises a framework having connected thereto a feeder device, a feed hopper, a crusher, a power unit and a discharge conveyor of crushed material.

The feeder device most generally used in mobile crushing units is a vibrating feeder that in its simplest form comprises a feeder hopper, a vibrator and springs on which the vibratory feeder rests on the crushing unit framework. During the operation of the crushing unit, material to be crushed is fed onto the vibrating feeder that by vibration conveys the material as a uniform flow into the crusher. Generally, a portion of the feed hopper bottom is provided with a grate that removes from the infeed material flow the fine aggregate fraction that might disturb the operation of the crusher. The small-sized aggregate falls through the classifier trough grate away from the feed hopper before the aggregate proceeds to the crusher proper. Generally, the fine aggregate removed via the grate is passed onto the crushed material discharge conveyor or onto a separate fine aggregate discharge conveyor that transports the fine aggregate away from crushing unit. The coarse aggregate to be crushed proceeds in the vibrating feeder to the crusher for comminution therein and then further onto the crushed aggregate discharge conveyor that removes the processed material form the crushing unit.

For easy infeed of material, the crushing unit framework generally carries an infeed hopper that directs the infeed material flow onto the vibrating feeder. Conventionally, the transportability of the crushing unit is enhanced by constructing the infeed hopper such that its walls are downward foldable for the duration of the crushing unit hauling by having the walls mounted on hinges that join the in feed hopper walls to the crushing unit framework.

Generally, the reciprocating motion of the vibrating feeder can be adjusted by controlling the operating frequency of feeder actuator and the weight and location of the eccentric masses of the vibrator. However, the movements of the vibrating feeder during crushing unit transportation are difficult to control. The major factors generating these random motions are the irregular contour of the road surface and the hauling speed of the crushing unit. Herein, there is a risk of the vibrating feeder jumping off from its support springs during transportation. This may cause damage to the feeder or even to the entire crushing unit.

To prevent damage during hauling, it is customary to secure the vibrating feeder to the crushing unit framework by different kinds of transport locking means such as wedges, cables, turnbuckle screws and the like securing devices. These methods are, however, clumsy and tedious in practical use.

The novel transport locking method disclosed herein offers a rapid and uncomplicated way of securing a vibrating feeder during transportation. The transport locking arrangement according to the invention advantageously utilizes the downward hingedly rotatable sidewalls of the crushing unit feeder hopper that in their lowered position secure the vibrating feeder to the framework of the mobile crushing unit with the help of locking means. In the present context, the term locking must be understood to comprise a securing facility capable locking the vibrating feeder to the crushing unit framework in a substantially rigid fashion. The securing facility may be implemented using means capable of engaging frictionally or by compatibly mating surfaces of the locking elements.

More specifically, the transport locking arrangement according to the invention is characterized by what is stated in the characterizing part of claim 1.

Next, the invention will be examined in greater detail by making reference to the attached figures wherein FIG. 1 shows a mobile crushing unit in elevational side view with the feeder and crusher parts illustrated in sectional views;

Figure 1:
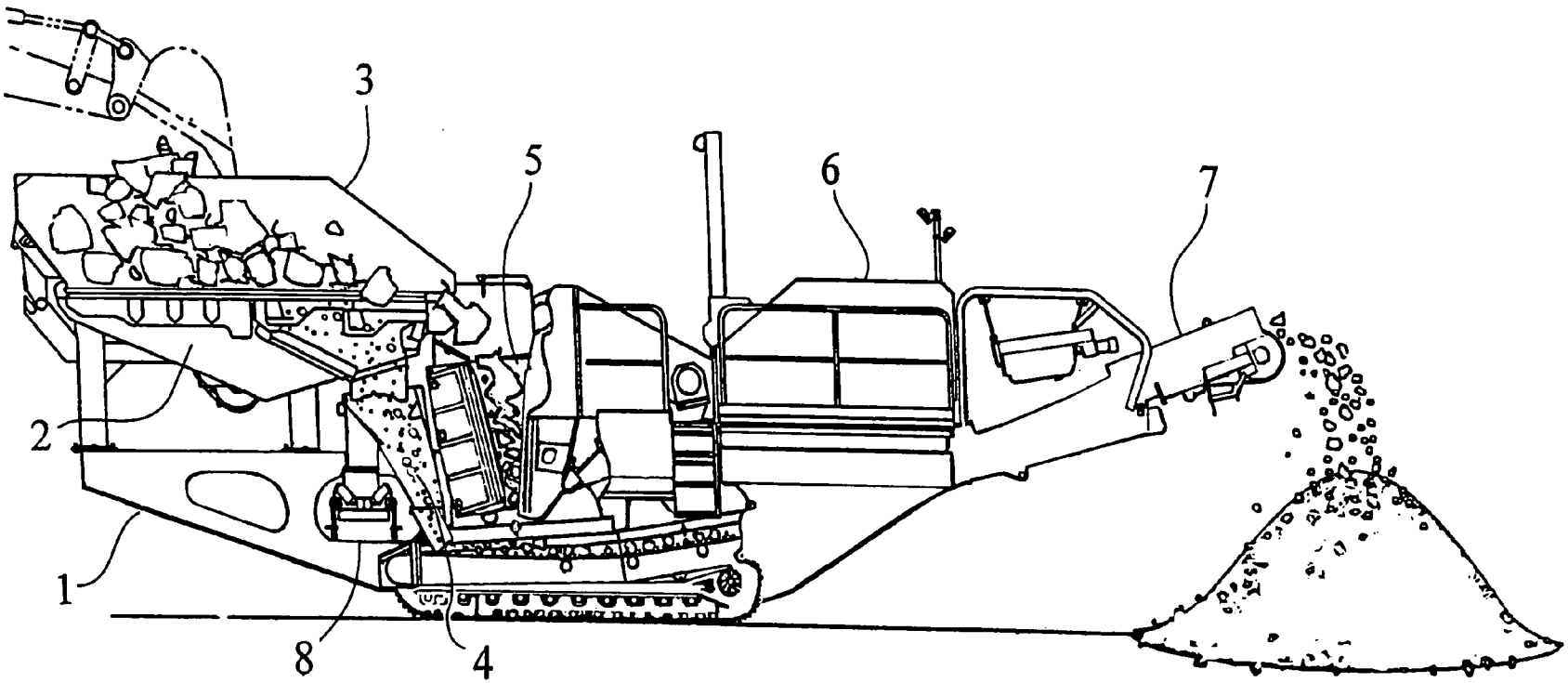
Fig. 1 (Related Art)

Referring to FIG. 1, an exemplary embodiment of a mobile crushing unit comprises a framework 1, a vibrating feeder 2, a feeder hopper 3, a classification trough 4, a jaw crusher 5, a power unit 6, a crushed material discharge conveyor 7 and a fine aggregate discharge conveyor 8.

During the operation of the crushing unit, material to be crushed in fed onto the vibrating feeder 2 by means of a bucket loader or conveyor, for instance. To make the loading of the material easier, a feeder hopper 3 is used having its walls hingedly mounted on the crushing unit framework and, for the duration of the crushing operation, rotated into an upper position as a chute. The vibrating feeder sets the material to be crushed into a vibratory motion in order to separate away from the material flow the fine aggregate fraction such as sand and small stones that disturb the function of the crusher. The fine aggregate falls down through the grate of the vibrating feeder and is directed by means of a classifying trough 4 either onto a fine aggregate discharge conveyor 8 running at right angles to the classifier or, as shown in the diagram to a crushed material discharge conveyor 7 that removes the crushed material from the crushing unit. The rest of the material flow to be crushed proceeds along the vibrating feeder into the crusher 5, wherein the material is crushed into desired aggregate size. The actuating power of the crusher, feeder and conveyors is delivered by a power unit 6. After crushing, the stone aggregate falls onto the crushed material discharge conveyor 7 adapted to run below the crusher so as to remove the crushed material from the crushing unit.

Figure 2:
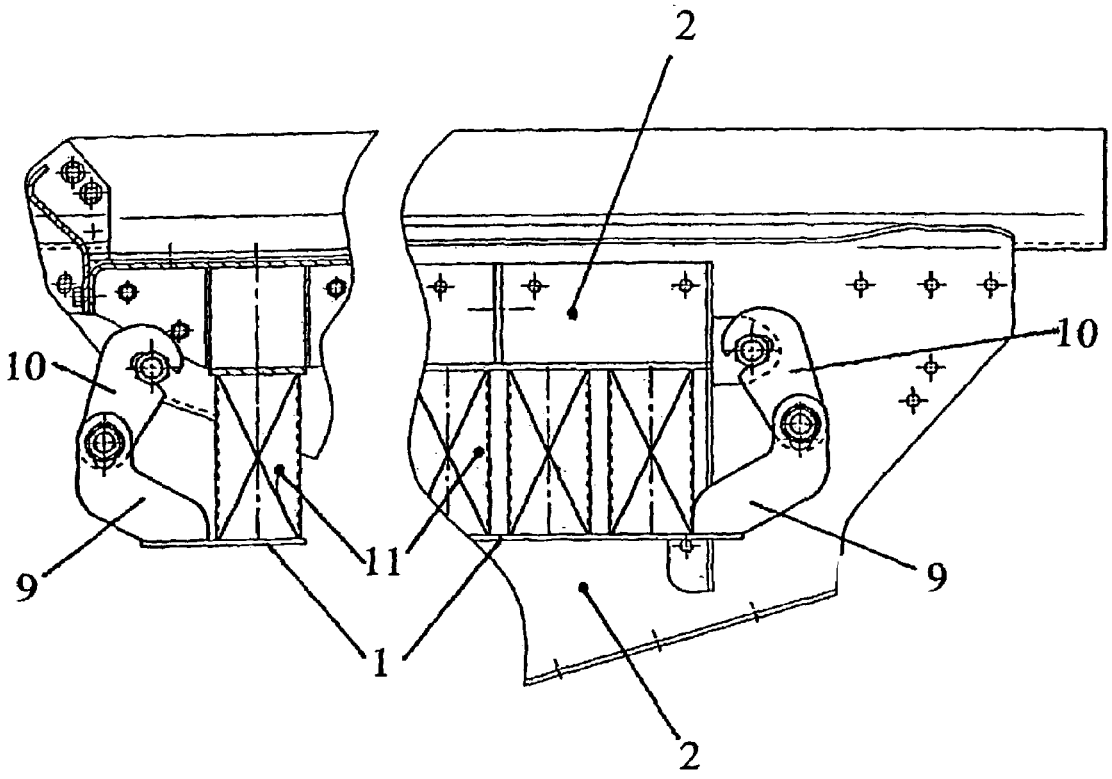
FIG. 2 shows an exemplifying embodiment of a conventional transport locking assembly of a vibrating feeder.

Now referring to FIG. 2, the exemplifying embodiment of a conventional transport locking arrangement shown therein for a vibrating feeder of a crushing unit is implemented with the help of locking means 9, 10 located at both ends of the vibrating feeder 2 and on both sides of the vibrating feeder. The locking means comprise two parts of which the lower part 9 is mounted on the framework 1 of the crushing unit. The upper part 10 of the locking means is pivotally connected to the lower part 9 by a pivot pin screw.

In its operating position, the vibrating feeder 2 rests supported by its springs 11 on the crushing unit framework 1. To engage the transport locking of the vibrating feeder, the screw of the pivotal joint between the upper part 10 and the lower part 9 of the locking means is slightly loosened and the upper part is rotated until its notch engages a bolt mounted on the frame of the vibrating feeder 2. Next, the screws are tightened to lock the pivotal joints between the upper and lower parts and to secure the end of the upper part of the locking means to the frame of the vibrating feeder. This kind of transport locking arrangement involves tedious and slow worksteps to engage and disengage the locking.

Figure 3:
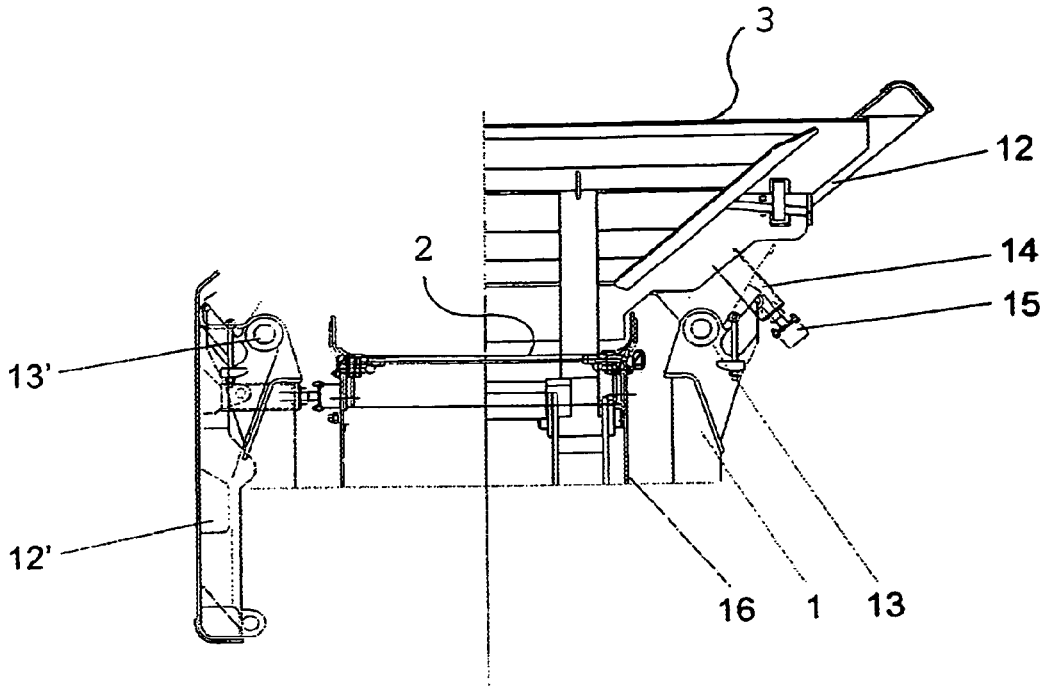
FIG. 3 shows a frictionally engaging transport locking assembly according to the invention.

In FIG. 3 is shown a frictionally engaging transport locking arrangement according to the invention wherein the main elements are the sidewalls 12, 12' of the feeder hopper 3, hinges 13, 13' of the sidewalls, a peg 14 serving as the locking member, an elastic pad 15 mounted on the end of the locking member, a framework 1 of the crushing unit and a feeder frame 16 of the vibrating feeder 2.

The pegs 14 serving as the locking members are rigidly mounted on the exterior surfaces of the feeder hopper sidewalls 12, 12'. When rotated into their lower position about the hinges 13, 13' mounted on the crushing unit framework 1, the weight of the feeder hopper sidewall 12 pushes the elastic pad 15 mounted on the end of the peg 14 acting as the locking member tightly against the wall of the feeder frame 16. Having both feeder hopper sidewalls 12, 12' rotated into their lower positions, the vibrating feeder 2 is frictionally secured to the crushing unit framework 1 ready for transportation.

Figure 4:
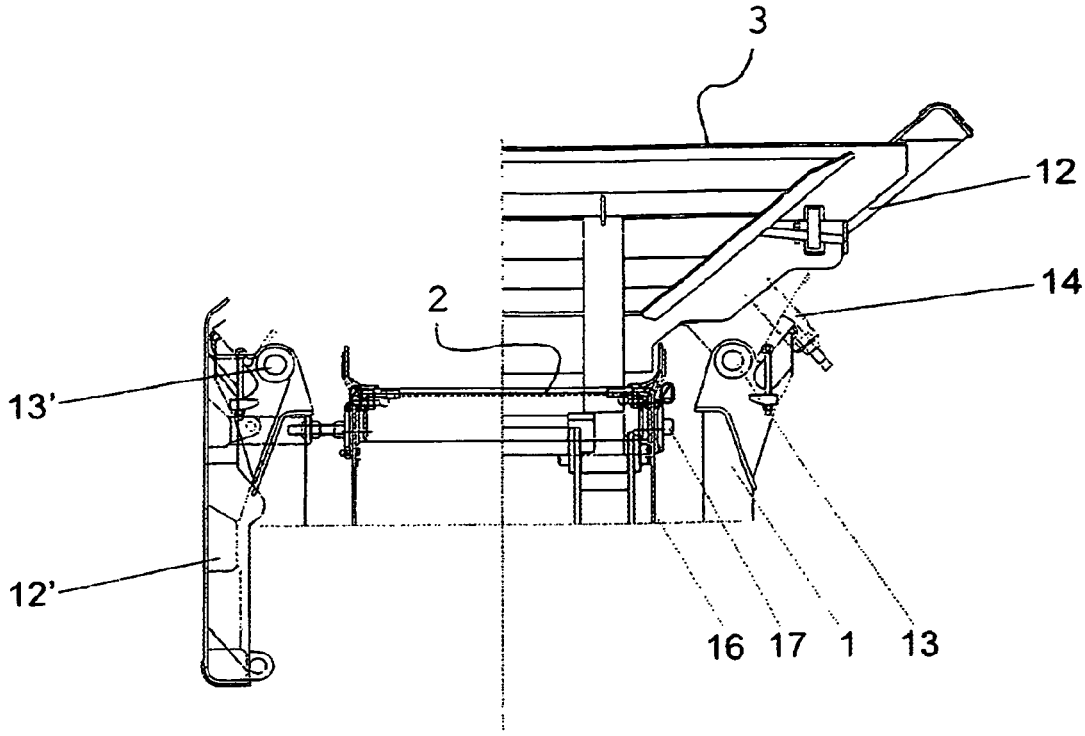
FIG. 4 shows a mating-element-engaging transport locking assembly according to the invention.

In FIG. 4 is illustrated an embodiment of the transport locking arrangement according to the invention based on locking by mating elements, whereby the walls of the feeder frame 16 of the vibrating feeder 2 is provided with a hole 17. In compatible position therewith is mounted a peg 14 on the sidewalls 12, 12' of feeder hopper 3. Resultingly, lowering the feeder hopper sidewall 12 into the transport position causes the peg 14 to engage with the hole 17 made on the wall of the feeder frame 16, whereby the compatible shapes of the peg 14 and the hole 17 lock the vibrating feeder 2 to the crushing unit framework 1.

Figure 5:
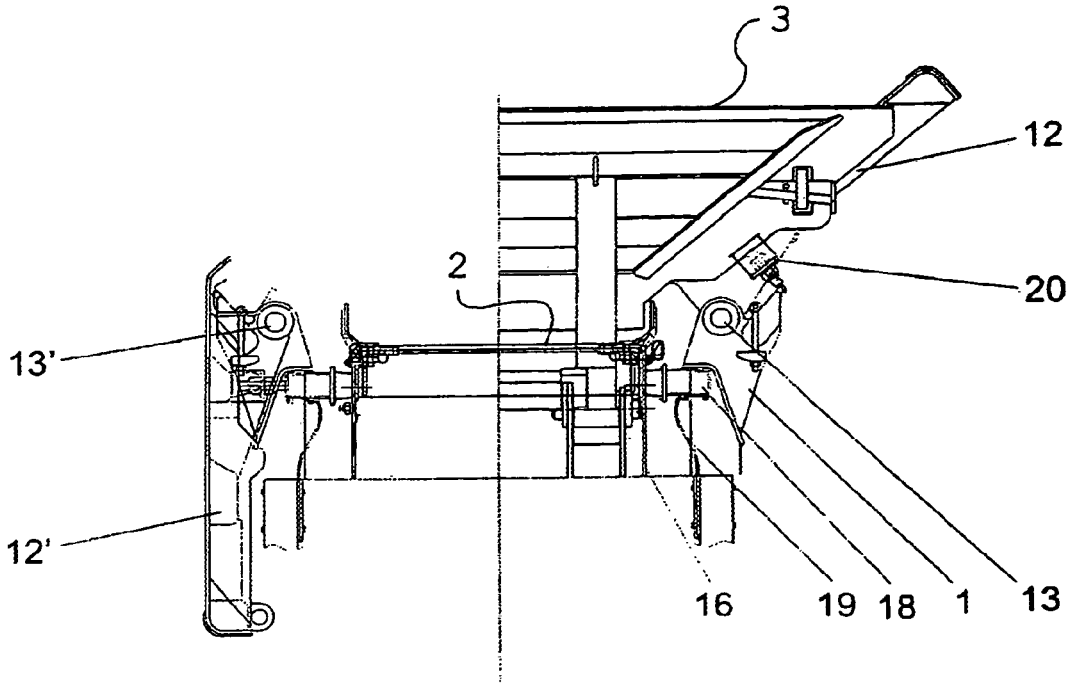
FIG. 5 shows a slidable-element-engaging assembly for the transport locking arrangement according to the invention.

In FIG. 5 is shown an embodiment of the locking arrangement according to the invention based on nonrigid mounting of the locking members, whereby the locking member 18 is connected to the crushing unit framework 1 by a springed mount 19. Then, having the feeder hopper sidewalls 12, 12' rotated into their lower positions makes the peg 20 mounted on the sidewall to push the locking member 18 against the wall of the feeder frame 16 of the vibrating feeder 2. Resultingly, the locking member 18 clamped between the peg 20 and the wall of the feeder frame 16 imposes sufficient friction to secure the feeder frame 16 in a rigid fashion against the feeder hopper sidewall 12 and, via the hinge 13 of the feeder hopper sidewall 12 to the crushing unit framework 1.

In a similar fashion, the springed mounting 19 of the locking member 18 to the crushing unit framework 1 may be replaced by a slidable mount that permits lateral movement of the locking member at right angles to the crushing unit framework.

Furthermore, the slidable engaging assembly shown in FIG. 5 may be implemented using securing elements of compatible shapes or frictional engaging similar to those of FIGS. 3 and 4.

The invention is not limited as to the number of locking members adapted between the vibrating feeder and the crushing unit framework to secure locking therebetween but rather, the number of locking members may be one or more on each one of the downward-rotatable sidewalls of the feeder hopper. Furthermore, there is no need to use discrete locking members provided that the feed chute walls of the vibrating feeder and the framework of the crushing unit can be shaped compatibly locking with each other in a rigid fashion when the sidewalls are rotated into the lower position.

Moreover, the invention is not limited as to the fashion the sidewalls of the feeder hopper are adapted movable. Instead, the feeder hopper sidewalls may alternatively be elevated by a separate lifting means and lowered gravitationally. Nevertheless, the sidewalls must be adapted lockable in their lower positions. Advantageous application of the invention are found in crushing units having the sidewalls of the feeder hopper made movable by hydraulic cylinders, whereby no separate lifting means is needed for elevating the sidewalls into their operating position and no locking members are needed for securing the sidewalls in their transport position.

What is claimed is:

1. A mobile crushing unit, comprising:

a vibrating feeder having a feeder frame;

a framework of the mobile crushing unit;

a feeder hopper having rotatable sidewalls; and transport locking means for locking the vibrating feeder to the framework of the mobile crushing unit, wherein at least one of the rotatable sidewalls of the feeder hopper is hingedly mounted to the framework of the mobile crushing unit, the rotatable sidewalls of the feeder hopper having an upper position and a lower position, at least one of the sidewalls of the feeder hopper, when rotated into the lower position, locks the vibrating feeder substantially rigidly to the framework of the mobile crushing unit by the transport locking means.

2. The mobile crushing unit of claim 1, wherein the transport locking means further comprises at least one locking member for frictionally securing the vibrating feeder to the framework of the mobile crushing unit.

3. The mobile crushing unit of claim 1, wherein the transport locking means includes an element on each of the rotatable sidewalls and the feeder frame, the elements having compatible mating shapes for securing the vibrating feeder to the framework of the mobile crushing unit.

4. The mobile crushing unit of claim 1, wherein an exterior surface of at least one of the rotatable sidewalls of the feeder hopper has mounted thereon at least one element which locks the vibrating feeder to the framework of the mobile crushing unit when at least one of the rotatable sidewalls is rotated into the lower position.

5. The mobile crushing unit of claim 4, wherein the rotatable sidewalls of the feeder hopper used for implementing the transport locking means of the vibrating feeder are longitudinal sidewalls of the feeder hopper.

6. The mobile crushing unit of claim 1, wherein at least one of an exterior surface of the feeder frame of the vibrating feeder has mounted thereon at least one element which locks the vibrating feeder to the framework of the mobile crushing unit when at least one of the rotatable sidewalls of the feeder hopper is rotated into the lower position.

7. The mobile crushing unit of claim 1, wherein on the framework of the mobile crushing unit is mounted at least one element that with the feeder hopper of the vibrating feeder having at least one of the rotatable sidewalls rotated into the lower position locks the vibrating feeder to the framework of the mobile crushing unit.

8. The mobile crushing unit of claim 1, wherein transport locking means includes an element mounted on each of the rotatable sidewalls of the feeder hopper and the feeder frame of the vibrating feeder for securing the vibrating feeder to the framework of the mobile crushing unit.

9. The mobile crushing unit of claim 1, wherein the transport locking means includes at least one locking member having a rod-shaped element adapted to connect for transportation at least one of the rotatable sidewalls of the feeder hopper and the feeder frame of the vibrating feeder with each other.

* * * * *